US005947487A

United States Patent [19]

Keleny et al.

[11] Patent Number: 5,947,487

[45] Date of Patent: Sep. 7, 1999

[54] IN-LINE SKATE WITH A FLEXING CUFF

[75] Inventors: Lloyd G. Keleny, Champlin; Donald R. Hudson, Bloomington, both of Minn.

[73] Assignee: Rollerblade, Inc., Minneapolis, Minn.

[21] Appl. No.: 08/803,206

[22] Filed: Feb. 11, 1997

[51] Int. Cl.[6] ..... A63C 3/02; A63C 17/06

[52] U.S. Cl. ..... 280/11.22; 36/115; 36/118.2; 188/5; 267/37.2; 280/11.36

[58] Field of Search ..... 267/37.2, 158; 36/109, 114, 115, 118.2, 119.1; 188/5; 280/11.2, 11.22, 11.27, 11.36, 811

[56] References Cited

U.S. PATENT DOCUMENTS

| | | | |
|---|---|---|---|
| 36,149 | 8/1862 | Haight | 280/11.36 |
| 214,231 | 4/1879 | Barney | 280/11.36 X |
| D. 327,360 | 6/1992 | Graham . | |
| D. 327,565 | 7/1992 | Graham . | |
| D. 344,119 | 2/1994 | Johnson et al. . | |
| D. 347,672 | 6/1994 | Arney et al. . | |
| D. 374,760 | 10/1996 | Edauw et al. . | |
| D. 376,254 | 12/1996 | Olson . | |
| D. 377,820 | 2/1997 | Edauw et al. . | |
| 540,036 | 5/1895 | Very | 280/11.36 X |
| 593,278 | 11/1897 | Moulton | 280/11.36 X |
| 1,497,224 | 6/1924 | Ormiston | 280/11.23 X |
| 1,892,944 | 1/1933 | Geyer et al. | 267/37.2 |
| 2,667,347 | 1/1954 | Jacobs | 267/37.2 |
| 2,731,275 | 1/1956 | Paden | 280/11.36 X |
| 3,303,584 | 2/1967 | Werner et al. | 36/118.2 X |
| 4,199,879 | 4/1980 | Wegeng . | |
| 4,454,663 | 6/1984 | Graillat et al. | 36/118.2 X |
| 5,171,033 | 12/1992 | Olson et al. . | |
| 5,226,875 | 7/1993 | Johnson | 36/114 X |
| 5,331,752 | 7/1994 | Johnson et al. . | |
| 5,380,020 | 1/1995 | Arney et al. . | |
| 5,408,763 | 4/1995 | Sartor et al. . | |
| 5,415,419 | 5/1995 | Bourque | 280/11.22 X |
| 5,570,522 | 11/1996 | Olson et al. . | |
| 5,678,833 | 10/1997 | Olson et al. . | |

FOREIGN PATENT DOCUMENTS

| | | | |
|---|---|---|---|
| 959743 | 4/1950 | France | 280/842 |
| 1485766 | 8/1971 | Germany . | |
| WO 96/01061 | 1/1996 | WIPO . | |

OTHER PUBLICATIONS

Two (2) photos of Mojo® Skate sold by Techno Circle Productions, UND. HANDELSGESELLSCHAFT of Austria.

*Primary Examiner*—J. J. Swann
*Assistant Examiner*—Michael Mar
*Attorney, Agent, or Firm*—Merchant & Gould P.C.

[57] ABSTRACT

An in-line skate is disclosed having a frame with a plurality of wheels and a boot coupled to the frame. The boot has a cuff and lower shell connected by a resilient connecting member that permits flexing along substantially the entire length of the member. The connecting member can be made of spring steel or a variety of synthetic materials.

25 Claims, 7 Drawing Sheets

IN-LINE SKATE WITH A FLEXING CUFF

TECHNICAL FIELD

The present invention relates generally to in-line roller skates. More particularly, the present invention relates to in-line roller skates having a flexing connection between a cuff and a lower shell of an in-line skate boot.

BACKGROUND

In recent years, in-line skating has become extremely popular. In-line skates generally have a frame and a boot attached to the frame. The boots of many in-line skates include hard outer shells covering portions of a soft inner liner. In some skates, the hard outer shell may be integrally molded with the soft liner. Typically, the shell includes a cuff and a lower shell that are pivotally connected. Pivotal connections between a cuff and a lower shell of an in-line skate boot are generally accomplished by a rivet, a bolt or another mechanism being disposed through coaxially aligned apertures in the cuff and lower shell. This pivotal connection is made on both right and left sides of each skate. The aperture in the cuff is sized to permit pivotal movement of the cuff about the rivet, bolt or other mechanism. Thus, pivotal movement of the cuff relative to the lower shell of an in-line skate boot have generally been confined to a relatively small, fixed area adjacent to a skater's ankle when the skater's foot is comfortably positioned in the boot.

Pivotal connections utilizing rivets generally pivot about a fixed axis which is defined by the rivet, bolt or other mechanism. Movement of an ankle joint of a human foot, however, does not occur around a fixed lateral axis. Rather, the axis about which a skater's foot flexes, may vary among skaters and may depend upon the shape, location and size of the talus of the skater's foot. In addition, the degree of rotation may vary between the medial and lateral mallet of each foot. Thus, conventional fixed-axis pivotal connections are limited in their ability to accommodate actual movement of a human foot.

The present invention provides a solution to this and other problems and offers other advantages over the prior art.

SUMMARY

The present invention relates to an in-line skate having a frame with a plurality of in-line skate wheels mounted on the frame and with the wheels being aligned in substantially a common plane. A boot, configured to receive a skater's foot, is coupled to the frame and has a cuff and a lower shell. A resilient connecting member has a length extending from a first end to a second end and is resilient substantially along its entire length. The first end of the connecting member is operably connected to the cuff and the second end of the connecting member is operably connected to the shell. The connecting member permits forward and rearward movement of the cuff relative to the lower shell from a rest position in response to forces upon the cuff with the connecting member being biased to return to the rest position.

DETAILED DESCRIPTION

Figure 1:
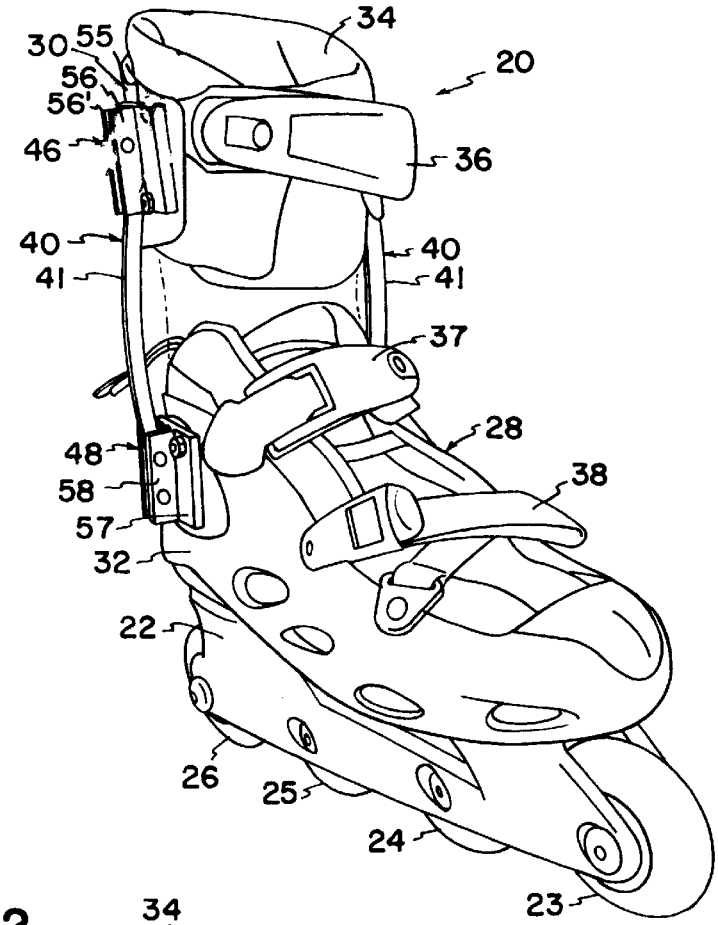
FIG. 1 is a perspective view of one embodiment of an in-line skate in accordance with the principles of the present invention, with an exposed connecting member and with an alternative embodiment of a continuous one piece liner shown in phantom lines.

With reference to the drawings in which like elements are numbered identically throughout, a detailed description of the invention is provided. This description does not limit the scope of the invention, which is limited only by the scope of the attached claims.

In general terms, the present invention relates to an in-line skate 20 with a flexing cuff 30. Each of the illustrated skates in the drawings is a right skate, and is used in combination with a left skate constructed in the mirror-image of the particular right skate. The in-line skate 20 includes a rigid frame 22 having a plurality of wheels 23, 24, 25 and 26 rotatably secured to the frame 22 about individual axes and substantially aligned in a common plane of rotation. The in-line skate 20 also includes a boot 28 that is operably coupled to the frame. The boot 28 includes the cuff 30 and a lower shell 32. A resilient connecting member 40 has a first end 42 operably connected to the cuff 30 and a second end 44 operably connected to the lower shell 32. The connecting member 40 is resilient along substantially its entire length. It will be apparent that any reference to a connecting member will refer to the connecting member disposed on the right side of the particular skate being referenced, which is shown in the referenced drawings, and the corresponding connecting member disposed on the left side of the same skate, which is generally not shown.

The boot 28 has a soft liner 34 which may be separated into upper and lower portions as shown in FIG. 1 or which may include one continuous soft liner as shown in phantom in FIG. 1. The boot 28 includes a plurality of closure devices 36, 37, 38 for securing the boot to the skater's foot. It will be apparent to those in the art that a variety of closure devices could be used on the skate 20, including a single closure device as disclosed in commonly-assigned U.S. Pat. No. 5,570,522. The cuff 30 and the lower shell 32 are typically formed of a semi-rigid or hard molded material.

A first fastener 46 and a second fastener 48 are used to secure the first end 42 of the connecting member 40 to the cuff 30 and the second end 44 of the connecting member 40 to the lower shell 32. In the embodiment shown in FIGS. 1 and 2, the first fastener includes a metal base 55 having two upwardly extending walls 56 and 56' that form a receiving channel. The receiving channel formed by the upwardly extending walls 56 and 56' is sized to receive the first end 42 of the connecting member 40. The first end 42 of the connecting member 40 is secured between the walls 56 and 56' by a securing mechanism such as, for example, a bolt, rivet or screw, that extends through the walls 56 and 56' and the first end 42 of the connecting member 40. The second fastener includes a metal base 57 having two upwardly extending walls 58 and 58' that form a receiving channel. The receiving channel formed by the upwardly extending walls 58 and 58' is sized to receive the second end 44 of the connecting member 40. The second end 44 of the connecting member 40 is secured between the walls 58 and 58' by a securing mechanism such as, for example, a bolt, rivet or screw, that extends through the walls 58 and 58' and the second end 44 of the connecting member 40. The first and second fasteners 46 and 48 are mounted to the cuff 30 and the lower shell 32, respectively, by a securing mechanisms such as, for example, bolts, rivets or screws.

Figure 2:
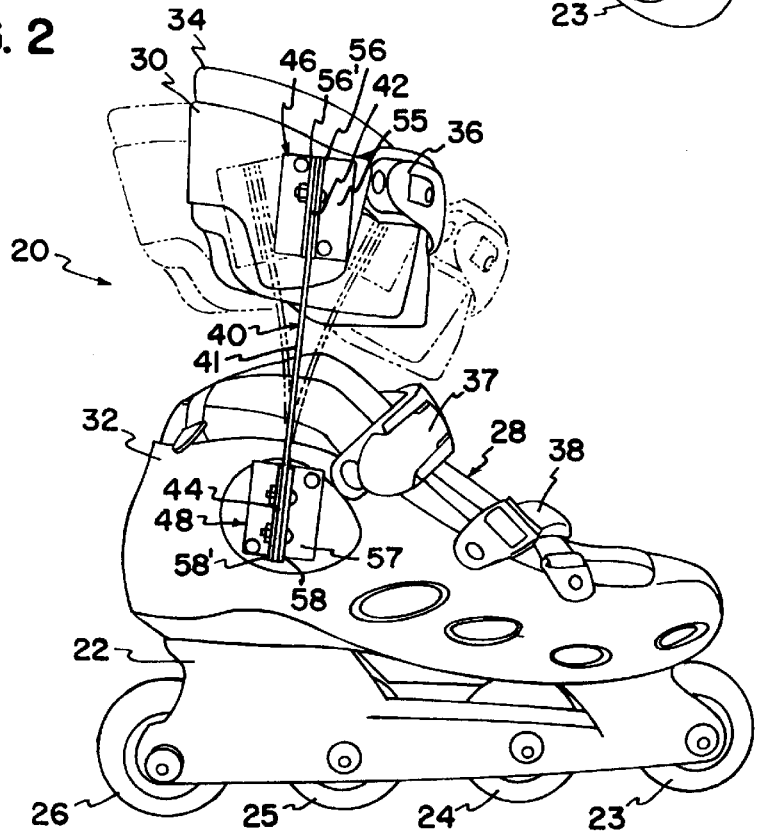
FIG. 2 is a left side elevational view of the in-line skate of FIG. 1, with forward and rearward movement of a cuff shown in phantom lines.

In one embodiment, shown in FIGS. 1 and 2, the connecting member 40 is made of spring steel, also known as carbon steel. In one embodiment, a desired spring constant of the connecting member 40 is thirty-five (35) to forty (40) pounds per inch. To achieve this desired spring constant, a rectangular plate of 1075 or 1095 steel may be used. Alternatively, 18-8 stainless steel may also be used. Preferably, the length of the spring steel is from 3 to 4.5 inches as measured between the first and second fasteners 46 and 48. Preferably, the spring steel has a width of ¼ to ½ of an inch. More preferably, the spring steel has a width of 3/16 to ¼ of an inch. Most preferably the spring steel has a width of ⅛ to 3/16 of an inch. The thickness of the spring steel is preferably from 0.042 to 0.162 inches. These characteristics are desirable for achieving approximately one (1) inch of forward and rearward deflection as the connecting member alternatively flexes forwardly and rearwardly. However, it will be apparent to those in the art that other characteristics may be combined to achieve desired spring constant of the connecting member.

Figure 3:
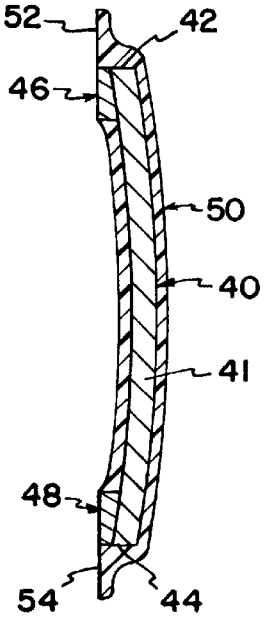
FIG. 3 is a cross-sectional view of a molded body covering over the connecting member and the fasteners of FIG. 1.

In FIGS. 1 and 2 the connecting member 40 and the fasteners 46 and 48 are exposed, without any body of material molded over the connecting member 40 and fasteners 46 and 48. FIG. 3 shows a cross-sectional view of the connecting member 40 and a molded body 50 molded over the connecting member 40 and the first and second fasteners 46 and 48. The molded body 50 has a first end 52 that is molded over the first fastener 46 and a second end 54 that is molded over the second fastener 48. The first and second ends 52 and 54 of the molded body 50 each define a contour around the outer perimeter of each of the fasteners 46 and 48. The molded body 50 also surrounds an intermediate portion 41 of the connecting member 40 extending between the first fastener 46 and the second fastener 48. Preferably, the molded body 50 follows the shape of the intermediate portion 41, defining a narrow contour between the first and second fasteners 46 and 48. The molded body may be made of a deformable material such as, for example, a thermoplastic material, a thermoplastic elastomer, or a thermoset elastomer.

The molded body 50 is desirable for several reasons. First, the molded body 50 provides a smooth outer surface over the connecting member 40 and the corresponding fasteners 46 and 48. In addition, the molded body 50 helps secure the first and second ends 42 and 44 of the connecting member 40. Finally, the molded body 50 helps distribute loads on the connecting member 40 and fasteners 46 and 48 over a larger area when the cuff is being flexed forwardly and rearwardly.

FIGS. 4–8 show various embodiments of the present invention. Connecting members shown in FIGS. 4–8 are shown connected to a skate 80 with a slightly different configuration than the skate 20 shown in FIGS. 1 and 2. However, it will be apparent to those skilled in the art that the connecting members can be used with a wide variety of skate configurations. The skate 80 in FIGS. 4–8 shows a frame 82 with a plurality of wheels 83, 84, 85 and 86 connected to the frame 82. A boot 88 having a cuff 90 and a lower shell 92 is shown connected to the frame 82. The boot 88 has a soft cuff portion 94 and a soft foot portion 96. Closure devices 97 and 98 are used to secure the boot 88 to a skater's foot. It will be apparent to those in the art that the soft cuff portion 94 and the soft foot portion 96 can be an unbroken continuous soft portion as shown in phantom in FIG. 1.

Figure 4:
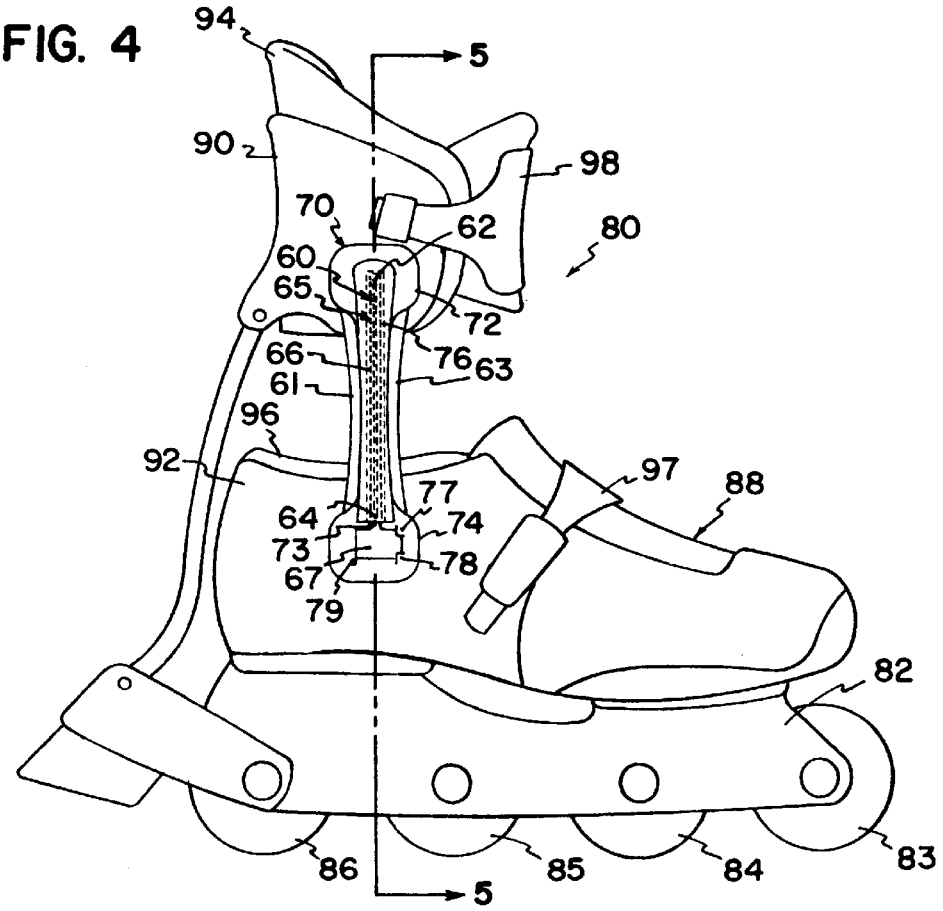
FIG. 4 is a schematic left side elevational view of an alternative embodiment of an in-line skate in accordance with the principles of the present invention having a removable connecting member.
Figure 5:
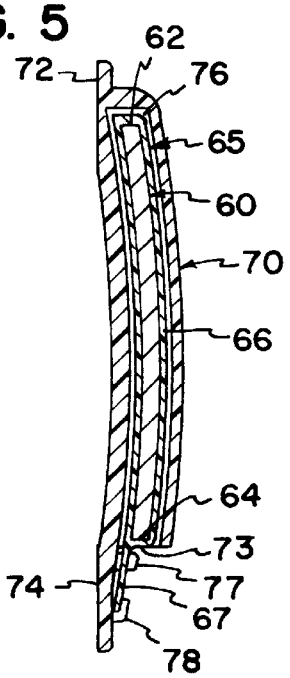
FIG. 5 is a cross-sectional view of the connecting member and a molded body of FIG. 4 taken along section line 5—5.

In accordance with one embodiment of the present invention, FIGS. 4 and 5 show a resilient connecting member 60 having a first end 62 operably connected to the cuff 90 and a second end 64 operably connected to the lower shell 92. The connecting member 60 is preferably made of spring steel or stainless steel having the same characteristics as previously described herein with reference to the connecting member 40 shown in FIG. 1. A member housing 65 has an elongated portion 66 encasing the connecting member 60. The member housing 65 has a tab 67 extending below the elongated portion 66 adjacent to the second end 64 of the connecting member 60. The member housing 65 may be made of a deformable material such as, for example, a thermoplastic material, a thermoplastic elastomer, or a thermoset elastomer.

A molded body 70 has a first end 72 connected to the cuff 90 and a second end 74 connected to the lower shell 92 and may be made of a deformable material such as, for example, a thermoplastic material, a thermoplastic elastomer, or a thermoset elastomer. The first and second ends 72 and 74 of the molded body 70 may be mechanically or chemically bonded to the cuff 90 and the lower shell 92 of the boot 88. Two elastomer ribs 61 and 63 are molded between the first and second ends 72 and 74 of the molded body 70, adjacent to opposing sides of the molded body 70.

The molded body 70 defines a cavity 76 extending from the first end 72 to an opening 73 in the second end 74. The cavity 76 is sized to slid ably receive the elongated portion 66 of the member housing 65 encasing the connecting member 60. The second end 74 of the molded body 70 includes hook portions 77, 78 and 79 defining a receiving slot for securing the tab 67 to the second end 74 of the molded body 70 such that the connecting member 60 is retained within the cavity 76. The tab 67 may have a handle or release button for removing the tab 67 from the receiving slot so that the elongated portion 66 and the encased connecting member 60 can be removed from the molded body 70. Thus, this configuration permits use of connecting members having a variety of different spring constants.

Figure 6:
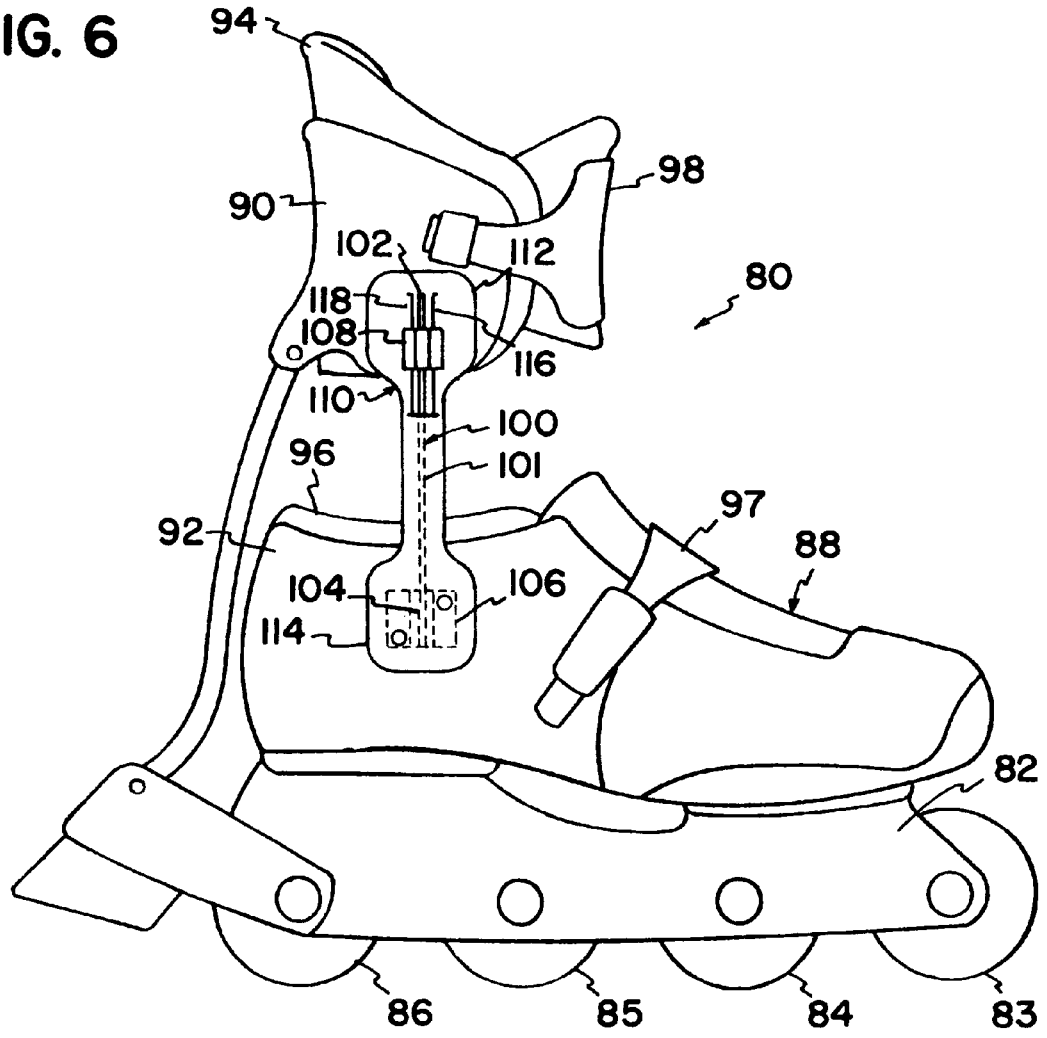
FIG. 6 is a schematic left side elevational view of another embodiment of an in-line skate in accordance with the principles of the present invention with one end of the connecting member being adjustable securable to a cuff.

FIG. 6 shows an alternative embodiment of the skate 80 in accordance with the principles of the present invention. A connecting member 100 has a first end 102 and a second end 104 operably connected to the cuff 90 and the lower shell 92, respectively. The second end 104 of the connecting member 100 is connected to the lower shell 92 by a fastener 106 having a configuration similar to the first and second fastener 46 and 48 shown and described with reference to FIGS. 1 and 2. The connecting member 100 is preferably made of spring steel or stainless steel having the same characteristics as previously described herein with reference to the connecting member 40 shown in FIG. 1.

A molded body 110 has a first end 112 mechanically or chemically bonded to the cuff 90 and a second end 114 molded over the fastener 106. It will be apparent, however, that the second end 104 of the connecting member 100 could be encased in the molded body 110 without the fastener 106, wherein the second end 114 of the body 110 would be mechanically or chemically bonded to the lower shell 92. The molded body 110 also has a portion surrounding an intermediate portion 101 of the connecting member 100, defining a narrow contour along the intermediate portion 101 of the connecting member 100. The molded body 110 may be made of a deformable material such as, for example, a thermoplastic material, a thermoplastic elastomer, or a thermoset elastomer.

The first end 112 of the molded body 110 provides an adjustable connection mechanism for securing the first end 102 of the connecting member 100 to the cuff. The first end 112 of the molded body 110 defines serrated ridges 116 and 118 on opposite sides of the first end 102 of the connecting member 100. A sliding fastener 108 secures the first end 102 of the connecting member 100 at a desired location along the ridges 116 and 118. The sliding fastener 108 is configured to securely engage the ridges 116 and 118 at any one of a plurality of locations along the first end 102 of the connecting member 100.

With the above-described configuration, a skater can secure the first end 102 of the connecting member 100 at a desired location to selectively increase or decrease the spring rate of the connecting member 100 and thereby permit more or less flexing of the cuff 90 as desired by the skater. If the sliding fastener 108 secures the connecting member 100 at the location farthest from the second end 104 of the connecting member 100, then the spring rate will be decreased and the skater will achieve the greatest amount of flexing. As the skater adjusts the sliding fastener 108 downwardly toward the second end 104 of the connecting member 100, the spring rate of the connecting member will increase and, consequently, the cuff will have less forward and rearward movement.

Figure 7:
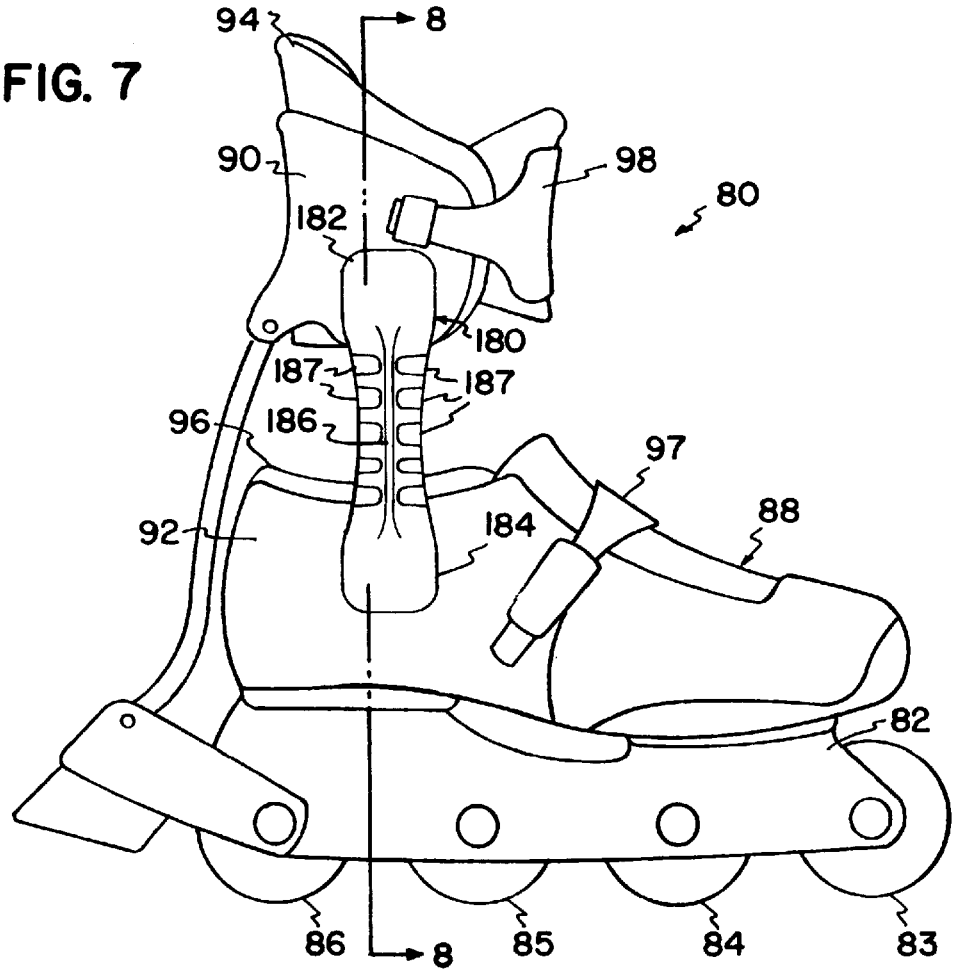
FIG. 7 is a schematic left side elevational view of yet another embodiment of an in-line skate in accordance with the principles of the present invention with a connecting member combined with a resilient material.
Figure 8:
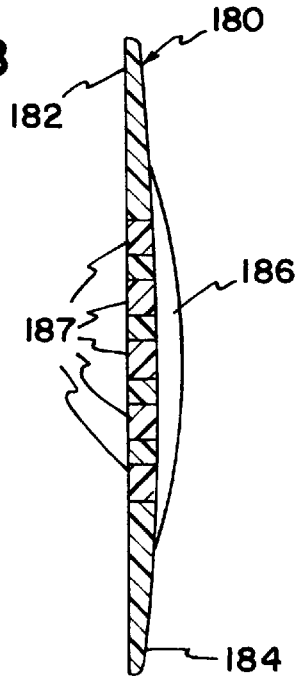
FIG. 8 is a cross-sectional view of the connecting member of FIG. 7 taken along section line 8—8.

FIGS. 7 and 8 show yet another embodiment of the skate 80 in accordance with principles of the present invention. A connecting member 180 has a first end 182 connected to the cuff 90 and a second end 184 connected to the lower shell 92. The connecting member 180 is preferably made of a deformable material such as, for example, a thermoplastic material. The connecting member has a wide contour at the first end 182 and the second end 184. An intermediate portion 181 of the connecting member 180, extending between the first and second ends 182 and 184 of the connecting member 180, has a narrow contour with oppositely disposed edges forming a plurality of grooves 187 therein. Each of the plurality of grooves 187 is substantially filled with a resilient material such as, for example, an elastomeric material. In addition, a middle portion 186 of the connecting member 100 bulges outwardly in a slightly convex shape extending from the first end 182 to the second end 184 of the connecting member 180 between the plurality of grooves 187 on each of the oppositely disposed edges of the connecting member 180. The connecting member 180 is proportionately greater in length than in width to provide lateral support to the skater's foot.

Figure 10:
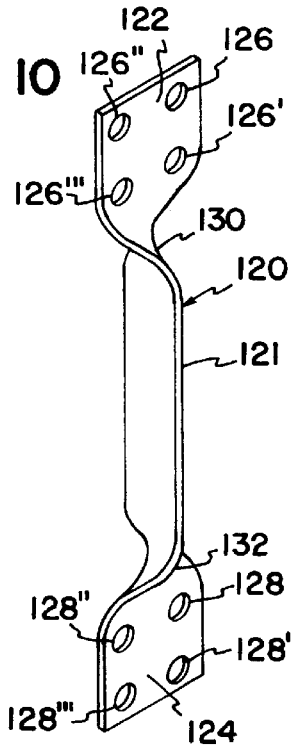
FIG. 10 is an enlarged perspective view of the connecting member of FIG. 9.

The elastomeric material within the plurality of grooves 187 biases the connecting member 180 to a rest position as shown in FIG. 10. However, the deformability of the elastomeric material in the plurality of grooves 187 allows the connecting member 180 to flex forwardly and rearwardly. The thickness of the connecting member 180 and the middle portion 186 that bulges outwardly help provide lateral support to a skater's foot. The first and second ends 182 and 184 of the connecting member 180 may be mechanically or chemically bonded to the cuff and lower shell 90 and 92, respectively. Alternatively, the connecting member 180 could form one continuous body of material with the cuff 90 and the lower shell 92. This embodiment is relatively inexpensive and simple to manufacture because only synthetic materials are used and, therefore, problems involving the combination of dissimilar materials is eliminated.

FIGS. 9 through 13 show various embodiments of the present invention. Connecting members shown in FIGS. 9–13 are shown connected to a skate 140 with a slightly different configuration than the skates 20 and 80 shown in FIGS. 1 and 4, respectively. However, it will be apparent to those skilled in the art that the connecting members shown and described with reference to FIGS. 9 and 13 can be used with a wide variety of skate configurations. The skate 140 in FIGS. 9–13 shows a frame 142 with a plurality of wheels 143, 144, 145 and 146 connected to the frame 142. A boot 148 having a cuff 150 and lower shell 152 is shown connected to the frame 142. The boot 148 has a soft cuff portion 154 and a soft foot portion 156. Closure devices 157 and 158 are used to secure the boot 148 to a skater's foot. It will be apparent to those in the art that the soft cuff portion 154 and the soft foot portion 156 can be an unbroken continuous soft portion as shown in phantom in FIG. 1.

Figure 9:
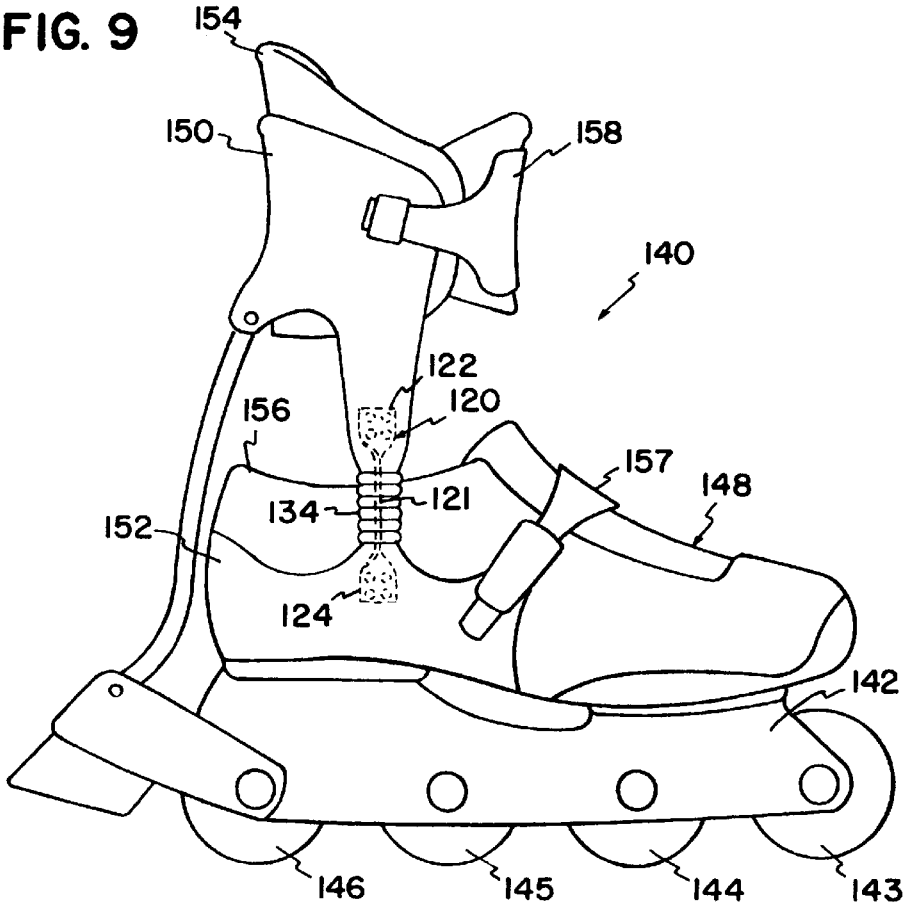
FIG. 9 is a schematic left side elevational view of a further embodiment of an in-line skate in accordance with the principles of the present invention having a connecting member mechanically bonded into a cuff and a lower shell of a boot.

With reference to FIGS. 9 and 10, a connecting member 120 has a first end 122 mechanically bonded to the cuff 150 and a second end 124 mechanically bonded to the lower shell 152. The connecting member 120 is preferably made of spring steel or stainless steel having the same characteristics as previously described herein with reference to the connecting member 40 shown in FIG. 1. An enlarged, perspective view of the connecting member 120 is shown in FIG. 8. The first end 122 of the connecting member 120 defines a plane and has a plurality of apertures 126, 126', 126", 126'". The second end 124 of the connecting member 120 defines a plane and has a plurality of apertures 128, 128', 128", 128'". Portions of the cuff 150 encase the first end 122 of the connecting member 120 and extend through the apertures 126–126'" to mechanically bond the first end 122 to the cuff 150. Portions of the lower shell 152 encase the second end 124 of the connecting member 120 and extend through the apertures 128–128'" to mechanically bond the second end 124 of the connecting member 120 to the lower shell 152. The cuff 150 and the lower shell 152 are preferably made of a semi-rigid material such as, for example, polyurethane. The planes defined by the first and second ends 122 and 124 of the connecting member 120 each are substantially parallel to the common plane of rotation of the wheels when the first end 122 is bonded to the cuff 150 and the second end 124 is bonded to the lower shell 152.

An intermediate portion 121 of the connecting member 120 extending between the first and second ends 122 and 124 is rotated by substantially 90°, forming upper and lower curvatures 130 and 132 in the connecting member 120. The intermediate portion 121 is rotated so that the connecting member 120 will flex forwardly and rearwardly, relative to the skate 140, along the intermediate portion 121. Finally, a soft bellows 134 is provided around the intermediate portion 121 of the connecting member 120 to cushion the ankle of the skater against the connecting member 120.

Figure 11:
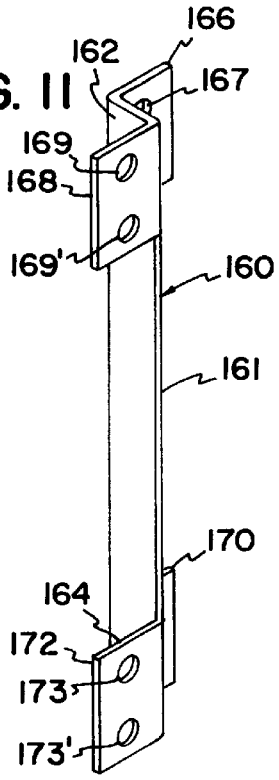
FIG. 11 is an enlarged perspective view of an alternative embodiment of the connecting member of FIG. 9.

FIG. 11 shows an alternative embodiment of a connecting member 160 for use in the skate 140, shown and described with reference to FIG. 9. The connecting member 160 is preferably made of spring steel or stainless steel having the same characteristics as previously described herein with reference to the connecting member 40 shown in FIG. 1. The connecting member 160 includes an upper forward flange 166 forwardly projected from one edge of a first end 162 of the connecting member 160. An upper rearward flange projects rearwardly from an opposite edge of the first end 162 of the connecting member. A lower forward flange 170 projects forwardly from one edge of a second end 164 of the connecting member 160. A lower rearward flange 172 projects rearwardly from an opposite edge of the second end 164 of the connecting member 160. The upper forward flange 166 has two apertures 167 (one aperture is not shown). The upper rearward flange 168 has two apertures 169 and 169'. The lower forward flange 170 has two apertures (not shown). The lower rearward flange 172 has two apertures 173 and 173'. The attachment of the connecting member 160 to the cuff 150 and the lower shell 152 is similar to that described with reference to the connecting member 120 of FIG. 10. The first end 162 is mechanically bonded to the cuff 150 and the second end 164 is mechanically bonded to the lower shell 152.

Figure 12:
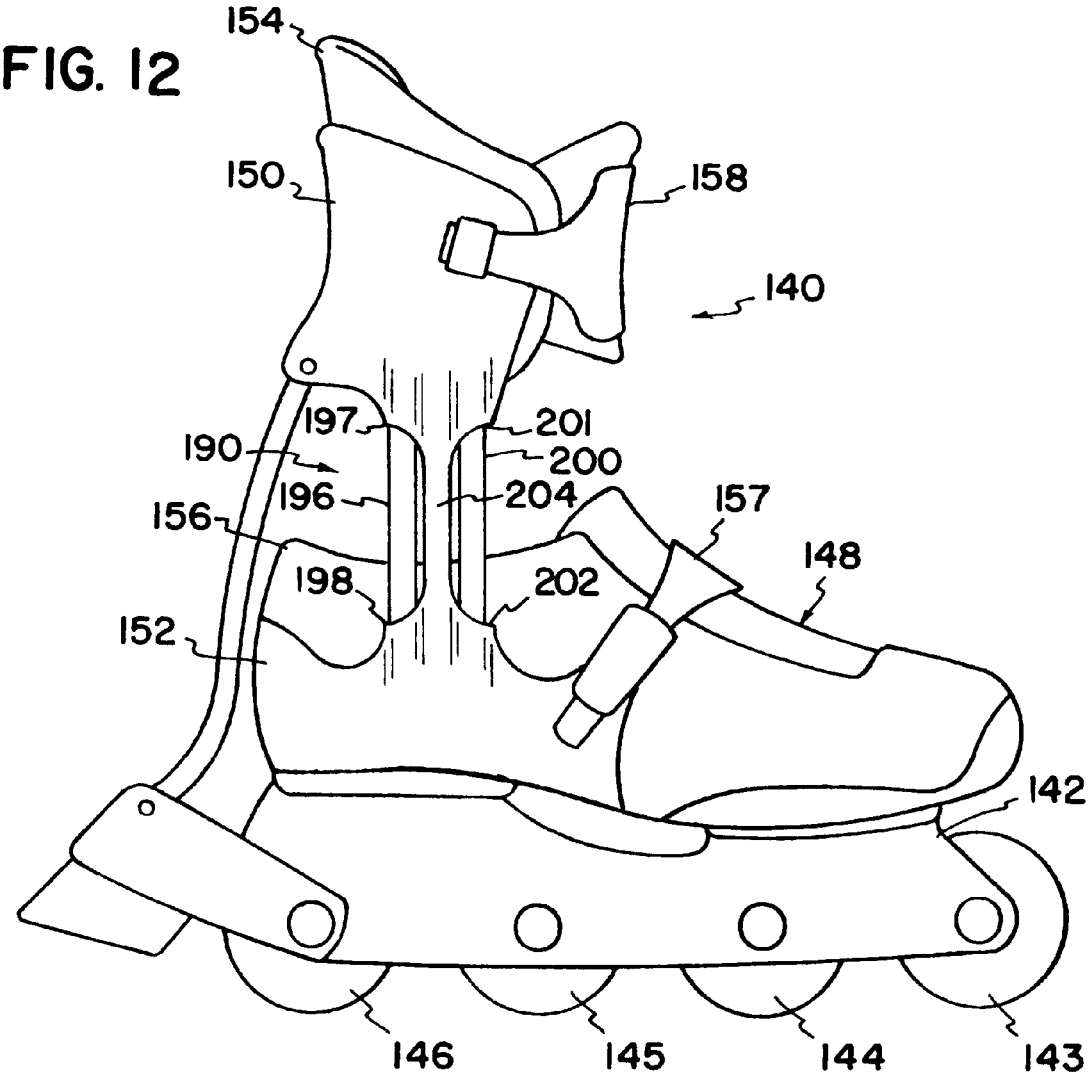
FIG. 12 is a schematic left side elevational view of yet a further embodiment of an in-line skate in accordance with the principles of the present invention, with the connecting member having a flexible portion cooperating with resilient support columns.

FIG. 12 illustrates another embodiment of the skate 140 in accordance with the principles of the present invention. An elongated member 204 has one end attached to the cuff 150 and an opposite end attached to the lower shell 152. Preferably, the elongated member 204 forms a continuous body of material with the cuff 150 and the lower shell 152 in which the body of material is a semi-rigid material such as, for example, polyurethane. The connecting member 190 includes resilient first and second columns 196 and 200. The first column 196 has an upper end received into a first recess 197 of the cuff 150. The first column 196 has a lower end received into a first recess 198 of the lower shell 152. The second column 200 has an upper end received into a second recess 201 in the cuff 150. The second column 200 has a lower end received into a second recess 202 of the lower shell 152. The first and second columns 196 and 200 are disposed on opposite sides of the elongated member 204. The first and second columns are preferably made of a resilient material such as, for example, an elastomeric material. The first and second columns 196 and 200 have a spring constant to bias the cuff 150 and the elongated member 204 back to a rest position after flexing forwardly or rearwardly. The elongated member 204 and the positioning of the first and second columns 196 and 200 help provide lateral support to the skater's foot.

Figure 13:
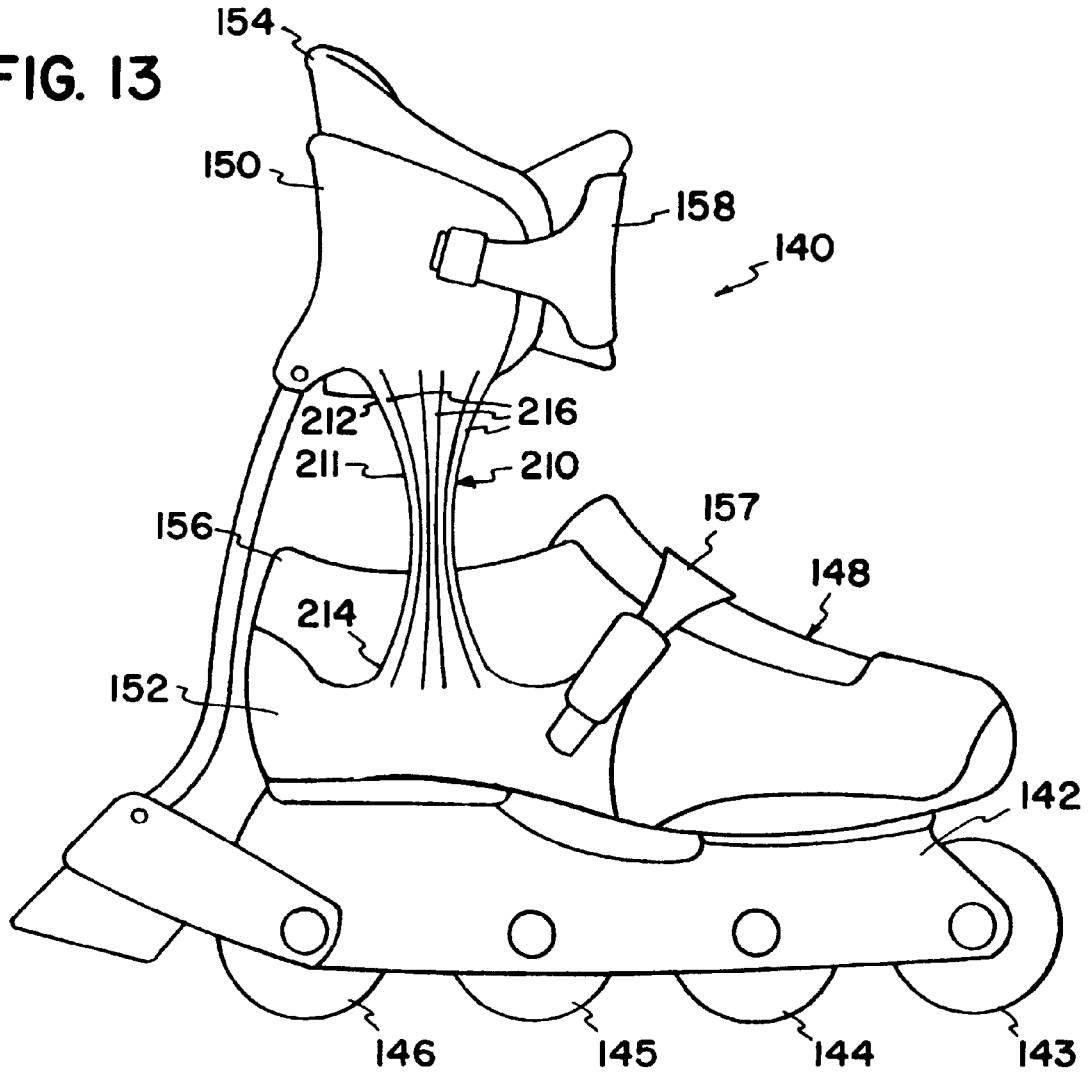
FIG. 13 is a left side elevational view of an even further embodiment of an in-line skate in accordance with the principles of the present invention, with a connecting member including a ribbed connection between a cuff and a lower shell of a boot.

FIG. 13 shows yet a further embodiment of a connecting member 210 according to the present invention. The connecting member 210 has a first end 212 connected to the cuff 150 and a second end 214 connected to the lower shell 152. Preferably, the connecting member 212 forms a continuous body of material with the cuff 150 and the lower shell 152 in which the body of material is a semi-rigid material such as, for example, polyurethane.

The connecting member 210 has an intermediate portion 211 between the first and second ends 212 and 214. The intermediate portion 211 has a narrow, curved contour. The connecting member 210 forms a plurality of ribs in close relation in the intermediate portion 211. The ribs 216 spread outwardly from the intermediate portion 211 to the first end 212 and spread outwardly from the intermediate portion 211 to the second end 214. The splayed rib design permits forward and rearward bending with a bias to a rest position as shown in FIG. 13. In addition, this configuration does not require any additional materials other than the semi-rigid material to form a molded shell.

In all of the above-described in-line skate embodiments, a skater's ankle is permitted to pivot about its normal axis with the cuff flexing in the same forward or rearward direction. The connecting member flexes along substantially its entire length and reduces forces on the foot to follow predetermined, fixed axial movement. The connecting member is biased to return to a rest position after the skater stops bending his or her foot. The connecting members are also designed to limit the lateral movement of the cuff, thereby supporting the skater's ankle.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

The claimed invention is:

1. An in-line skate comprising:

a rigid frame having a plurality of in-line skate wheels secured thereto, said plurality of in-line skate wheels being substantially aligned in a common plane;

a boot including a cuff, a lower shell and a soft shoe, said boot operably coupled to said frame, said boot including a lateral side positioned opposite from a medial side, and the cuff being positioned above said lower shell and spaced therefrom; and a resilient connecting member positioned at one of the lateral side and the medial side of the boot, the resilient connecting member having a length extending from a first end to a second end and with said connecting member being resilient substantially along said length, the resilient connecting member including a flat spring, said first end of said member rigidly connected to said cuff and said second end of said member rigidly connected to said lower shell, said connecting member permitting forward and rearward movements of said cuff relative to said lower shell from a rest position in response to forces upon said cuff, said cuff moving along a line of travel defined by forward and rearward flexing movements of said member, said member biased to return to said rest position, said flat spring having a first dimension extending along a width of the boot and a second dimension extending along a length of the boot, the first dimension being thicker than the second dimension for providing the connecting member with greater flexibility in a first orientation corresponding to the length of the boot and with lesser flexibility in a second orientation corresponding width of the boot.

2. The in-line skate of claim 1 wherein said cuff is spaced from said lower shell, said member restricting lateral movement of said cuff relative to said lower shell.

3. The in-line skate of claim 1 wherein said soft shoe comprises a soft cuff portion attached to said cuff and a soft foot portion attached to said lower shell.

4. The in-line skate of claim 1 further comprising:

a first fastener for securing said first end of said connecting member to said cuff; and a second fastener for securing said second end of said connecting member to said lower shell.

5. The in-line skate of claim 4 wherein said length of said connecting member is from three to four and one-half inches as measured between said first fastener and said second fastener.

6. The in-line skate of claim 1 wherein said flat spring is made of a spring steel material having a predetermined spring constant.

7. The in-line skate of claim 6 wherein said spring constant of said flat spring is measured from thirty-five to forty-five pounds per inch of deflection measured at said first end of said connecting member.

8. The in-line skate of claim 6 wherein the first dimension of the flat spring measures from ⅛ of an inch to ½ of an inch.

9. The in-line skate of claim 6 wherein the second dimension of the flat spring measures from 0.042 inches to 0.162 inches.

10. The in-line skate of claim 1 further comprising a molded body encasing said flat spring, said body securing said first and second ends of said connecting member to said cuff and said lower shell, respectively.

11. The in-line skate of claim 10 wherein said body is made of a deformable material.

12. The in-line skate of claim 10 wherein said body defines a narrow contour along an intermediate portion of said member between said first and second ends of said connecting member; and said body defining thick contours around each of said first and second ends of said connecting member, each of said thick contours having a width greater than said narrow contour.

13. The in-line skate of claim 1 further comprising an adjustable fastener movable along said first end of said connecting member for selectively securing said member to said cuff at a desired location along a length of said first end.

14. The in-line skate of claim 1 further comprising:

a member housing having an elongated portion encasing said flat spring and having a tab end extending from one end of said elongated portion;

a molded body having a first end fixedly attached to said cuff and having a second end fixedly attached to said lower shell, said body defining a cavity extending between said first and second ends of said body, said second end of said body defining an opening communicating with said cavity, said cavity sized to receive said elongated portion of said member housing through said opening; and said second end of said body defining a receiving slot for releasable receiving said tab end of said housing.

15. The in-line skate of claim 1 wherein said first end of said connecting member is mechanically bonded to said cuff; and wherein said second end of said connecting member is mechanically bonded to said lower shell.

16. The in-line skate of claim 15 wherein each of said first and second ends of said connecting member define a plurality of apertures;

said cuff encasing said first end of said connecting member with portions of said cuff being disposed through said pluralities of apertures of said first end of said connecting member; and said lower shell encasing said second end of said connecting member with portions of said lower shell being disposed through said pluralities of apertures of said second end of said connecting member.

17. The in-line skate of claim 15 wherein said connecting member is made of spring steel and is a substantially flat rectangular shape;

each of said first and second ends of said connecting member defining a plane, each of said planes being substantially parallel to said common plane of said plurality of wheels when said first and second ends are mechanically bonded to said cuff and said lower shell respectively; and said connecting member including an intermediate portion extending between said first and second ends, said intermediate portion rotated by approximately 90 degrees such that said intermediate portion is substantially perpendicular to said planes of said first and second ends.

18. The in-line skate of claim 15 wherein said connecting member is made of spring steel, a portion of said connecting member being substantially flat along said length of said member;

said first end of said connecting member having two oppositely disposed projections; and said second end of said connecting member having two oppositely disposed projections.

19. The in-line skate of claim 15 further comprising a flexible bellows surrounding an intermediate portion of said connecting member extending between said first and second ends of said connecting member.

20. The in-line skate of claim 1 wherein said boot includes a sole, said soft shoe extending continuously from said sole of said boot to at least an upper edge of said cuff.

21. An in-line skate comprising:

a frame to which a plurality of tandems arranged in-line skate wheels are secured;

a boot having a lower shell and a cuff, the frame being operatively coupled to the lower shell, the boot including a length and a width, the boot including lateral and medial sides positioned on opposite sides of the width, and the cuff being spaced above the lower shell; and a medial connecting structure positioned at the medial side of the boot and a lateral connecting structure positioned at the lateral side of the boot, each connecting structure including a flat spring member extending between the cuff and one of the lower shell and frame, each connecting structure being rigidly connected at a first end to the cuff and also being rigidly connected at a second end to one of the lower shell and the frame, the connecting structures permitting forward and rearward movement of the cuff relative to the lower shell from a rest position in response to forces on the cuff, the cuff moving along a line of travel defined by forward and rearward flexing movements of the connecting structures, the connecting structures being biased to return the cuff to the rest position, the spring member of each connecting structure having a first flexibility in a first orientation corresponding to the length of the boot and a second flexibility in a second orientation corresponding to the width of the boot, and the spring member of each connecting structure being thicker along the second orientation than along the first orientation such that the first flexibility has a greater magnitude than the second flexibility, wherein the spring members more freely permit forward and rearward movement of the cuff as compared to lateral movement of the cuff.

22. The in-line skate of claim 21, wherein the connecting structures are at least partially made of plastic.

23. The in-line skate of claim 21, wherein the spring members are covered a polymeric outer layer.

24. The in-line skate of claim 21, wherein the spring members each include a metal portion.

25. The in-line skate of claim 24, wherein each metal portion is made of spring steel.

* * * * *

UNITED STATES PATENT AND TRADEMARK OFFICE

CERTIFICATE OF CORRECTION

PATENT NO. : 5,947,487

DATED : SEPTEMBER 7, 1999

INVENTOR(S) : KELENY ET AL.

It is certified that error appears in the above-identified patent and that said Letters Patent is hereby corrected as shown below:

Col. 1, line 35: "mallet" should read --malleoli--

Col. 4, line 61: "slid ably" should read --slidably--

Col. 9, line 3: insert --to the-- after the word "corresponding"

Col. 9, line 64: "releasable" should read --releasably--

Col. 10, line 46, claim 21: "tandems" should read --tandemly--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*